United States Patent [19]

Prandina

[11] Patent Number: 4,573,227

[45] Date of Patent: Mar. 4, 1986

[54] BLANKET ASSEMBLY COMPOSED OF AT LEAST TWO INTERCONNECTABLE BLANKETS, FOR SINGLE AND DOUBLE BEDS

[75] Inventor: Aldo F. Prandina, Busto Arsizio, Italy

[73] Assignee: Ing. Loro Piana & C. S.p.A., Quarona Sesia, Italy

[21] Appl. No.: 607,447

[22] Filed: May 7, 1984

[30] Foreign Application Priority Data

May 5, 1983 [IT] Italy ..... 53285/83[U]

[51] Int. Cl.[4] ..... A47G 9/02; A47G 9/04

[52] U.S. Cl. ..... 5/486; 5/502

[58] Field of Search ..... 5/486, 482, 420, 417, 5/413, 500, 496, 502

[56] References Cited

U.S. PATENT DOCUMENTS

| | | | |
|---|---|---|---|
| 917,403 | 4/1909 | Benger | 5/413 |
| 1,267,042 | 5/1918 | Arnold | 5/486 |
| 2,064,458 | 12/1936 | Bulpit et al. | 5/413 |
| 2,730,728 | 1/1956 | Roberts | 5/486 |
| 2,789,292 | 4/1957 | Budinquest | 5/496 |
| 3,319,273 | 5/1967 | Solin | 5/420 |
| 3,331,088 | 7/1967 | Marquette | 5/486 |
| 3,508,285 | 4/1970 | Marquette | 5/486 |
| 4,069,526 | 1/1978 | Deikel | 5/486 |
| 4,231,125 | 11/1980 | Tittl | 5/419 |

FOREIGN PATENT DOCUMENTS

| | | | |
|---|---|---|---|
| 2458257 | 2/1981 | France | 5/486 |

*Primary Examiner*—Alexander Grosz

*Attorney, Agent, or Firm*—Young & Thompson

[57] ABSTRACT

A blanket assembly composed of interconnectable blankets, for single and double beds, comprises at least two single bed blankets, provided, along at least one of their sides, with buttons and buttonholes, respectively, disposed at such a mutual distance as to allow buttoning the sides to one another.

3 Claims, 5 Drawing Figures

BLANKET ASSEMBLY COMPOSED OF AT LEAST TWO INTERCONNECTABLE BLANKETS, FOR SINGLE AND DOUBLE BEDS

The invention relates to an assembly of mutually connectable blankets, for single and double beds.

The main object of the invention is to provide a blanket assembly for beds, composed of two blankets or groups of blankets which are interconnectable so that a single blanket or group of blankets may be used on single beds, while the blanket assembly obtained by interconnecting the two blankets or groups of blankets may be used on double beds.

The practicalness of this solution is evident, since it allows using the blanket assembly, for example in a family, on the double bed of the parents or on the single beds of the children.

Innumerable are the other cases in which this blanket assembly may be useful, for example under a tent, in a caravan, camper, or for journeys for which it is unknown whether it might be necessary to sleep in a double bed or in twin beds.

A typical example is that of a couple in which one of the two persons requires more blankets than the other person.

Another object of the invention is to provide means for connecting the blankets forming the assembly, which means will be extremely practical and easy to couple to and uncouple from each other.

To attain these and other objects which will be better understood from the following description, the invention proposes to provide a blanket assembly for single and double beds, comprising at least two single bed blankets, provided, along at least one of their sides, with buttons and buttonholes, respectively, disposed at such a mutual distance as to allow buttoning said sides to one another.

The blanket assembly according to the present invention will now be described with reference to the accompanying drawings, in which.

Figure 1:
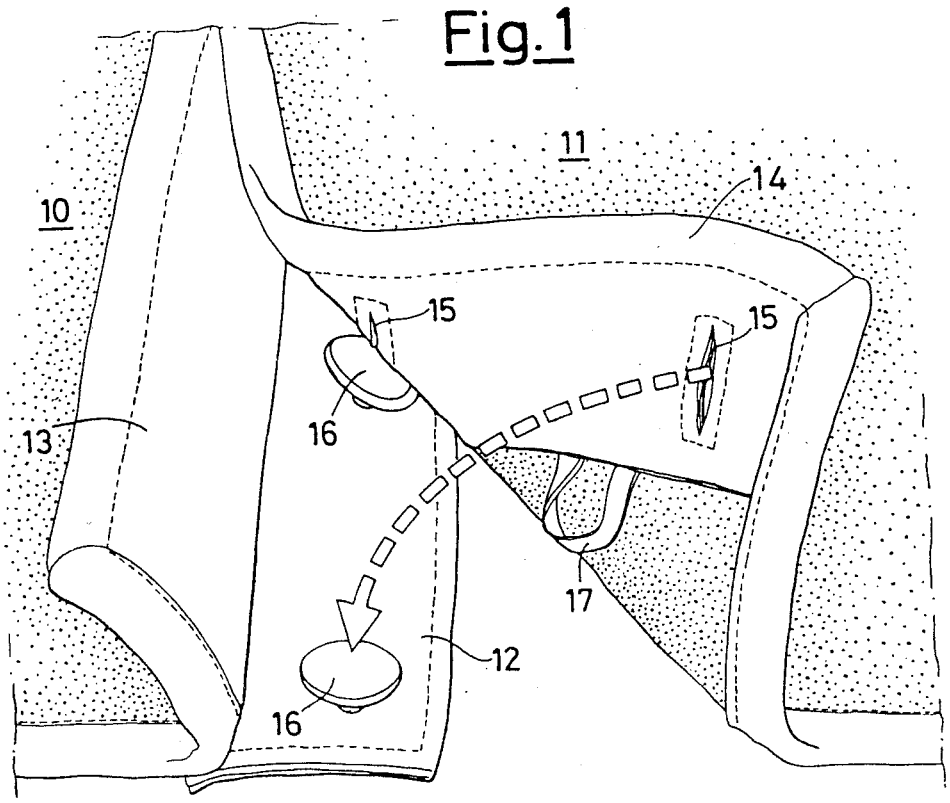
FIG. 1 is a view of an edge of the blanket assembly according to the invention in course of being assembled.

Two blankets 10 and 11 of common type or, anyway, easy to be found on the market, are interconnectable by means of the technical solution according to the invention, consisting in applying, all along a side 13 of one of the two blankets, e.g. 10, a strip 12 of cloth or other suitable material, along which variously spaced buttons 16 are applied.

All along a side 14 of the other blanket 11, instead, there are provided buttonholes 15 disposed at mutual distances equal to those existing between the buttons 16 of the other blanket 10.

Figure 2:
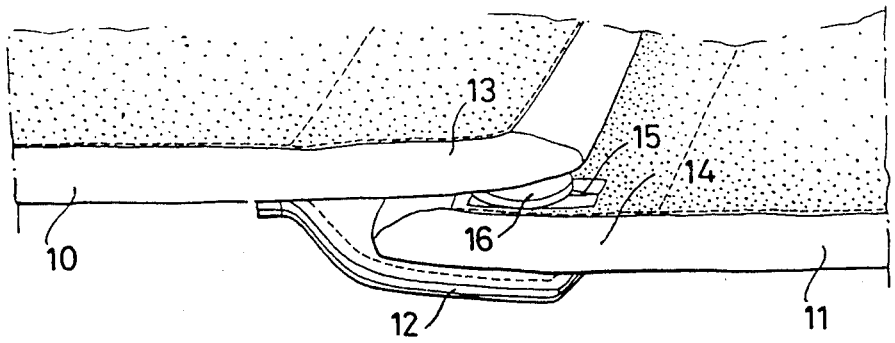
FIG. 2 is a view of the edge shown in FIG. 1, after the assembling.

It is thus evident and obvious that it is sufficient to introduce the side 14 of the blanket 11 between the side 13 and the strip 12 of the blanket 10, and to insert each button 16 into the respective buttonhole 15, in order to assemble the two blankets 10 and 11 along the respective sides 13 and 14, as shown in FIG. 2.

In this way, the two sides 13 and 14 will result in being overlapped and the buttons 16 will thus be concealed by the side 13, thus providing an excellent blanket assembly which will be not only practical and functional, but also of undoubted aesthetical value.

Figure 3:
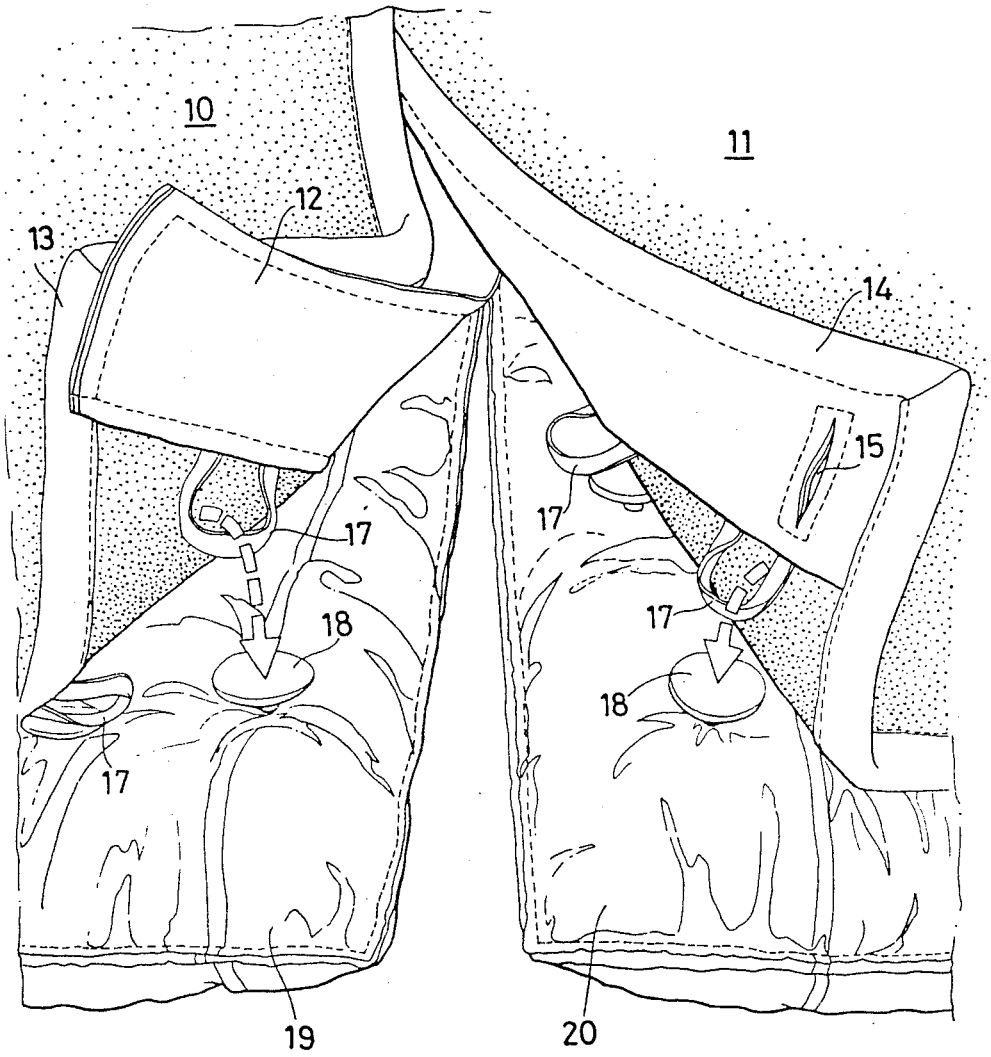
FIG. 3 shows an edge of the blanket assembly of FIG. 1, in course of being coupled to further blankets.
Figure 4:
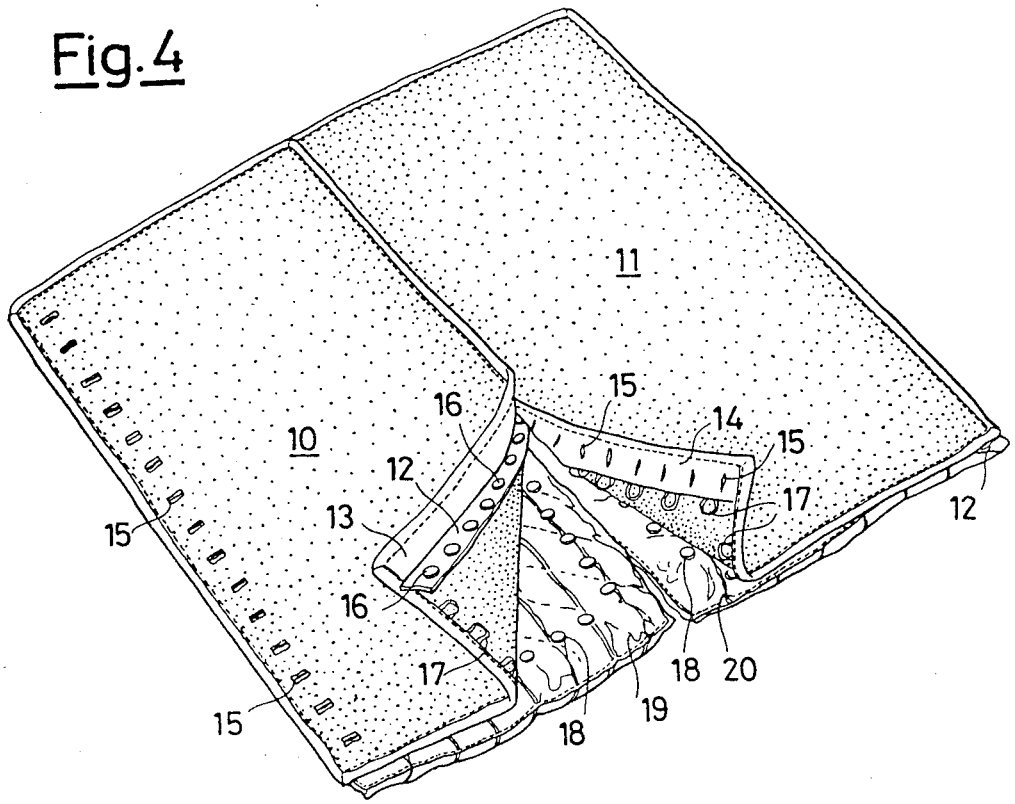
FIG. 4 is a complete view of the group shown in FIG. 3.

It will be seen from FIG. 1 that a further buttonhole 17 is provided on the side 14 of the blanket 11; as shown in FIGS. 3 and 4, also these buttonholes 17 are provided all along the side 14 and also in the lower part of the strip 12 of the blanket 10, as well as all along the remaining periphery of the two blankets 10 and 11.

Figure 5:
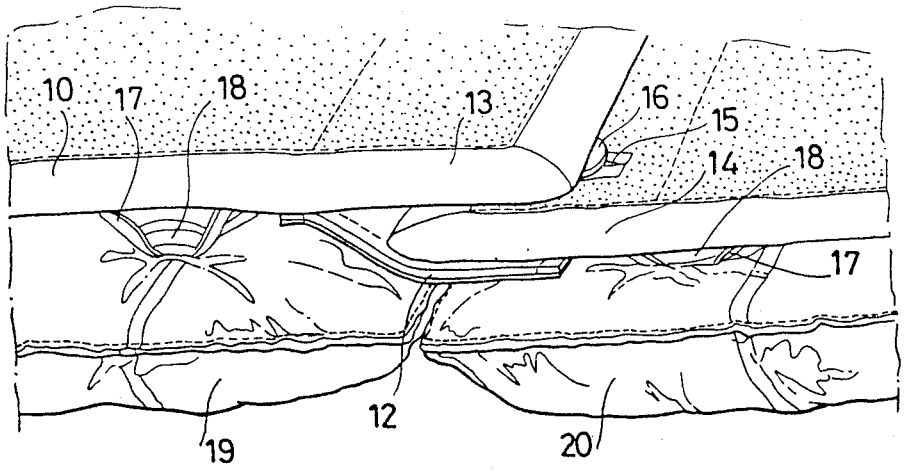
FIG. 5 is a view of the edge shown in FIG. 3, after the assembling.

As shown in FIGS. 3,4 and 5, these buttonholes 17 serve to insert thereinto the buttons 18 of two further underlying blankets 19 and 20, so as to double the blankets or to complete the assembly (in case that the blankets 10 and 11 are by simply by woven plaids and the blankets 19 and 20 are quilts).

The final result is illustrated in FIGS. 4 and 5 wherein all the blankets 10, 11 and 19, 20 are assembled so as to form together a single blanket assembly for a double bed.

It is obvious that, for example, there may be only one quilt 19 or 20 in the case that only one of the persons needs having more warmth.

Moreower, as shown in FIG. 4, the buttonholes 15 and the strip 12 with the relevant buttons 16 will be applied on both blankets 10 and 11 along the two longer sides, so as render interchangeable at will the blankets and, eventually, extend them by means of other identical blankets to form a larger blanket assembly.

I claim:

1. A blanket assembly composed of interconnectible blankets for single and double beds comprising at least two rectangular elongated single bed blankets, each having on one of its longer edges a flap attached thereto at a distance from the end of that edge, so as to constitute together with the end portion of that edge an open pocket, said flap having buttons along the side facing said edge, and the opposite longer edge of each blanket having buttonholes disposed at spaced locations corresponding to the locations of said buttons on said flap so as to allow joining together two such blankets in such a way that the edge provided with buttonholes of a blanket is inserted between the flap and the edge provided with said flap of another blanket, said buttonholes being formed in and extending entirely through the same material as the material of the blanket between said edges, whereby two full thicknesses of said material overlap with said buttons between them.

2. A blanket assembly as claimed in claim 1 each blanket having loops on the side to which said flap is attached, said loops extending along said one longer edge, said loops being disposed at spaced locations along the four edges of each blanket, so as to allow each blanket to be joined to an underlying blanket.

3. A blanket assembly as claimed in claim 7, in combination with two said underlying blankets, each underlying blanket having buttons along all four edges, said buttons being disposed at locations corresponding to the locations of said loops, so as to allow each overlying blanket to be joined along its four edges to one of said underlying blankets.

* * * * *